US012331513B1

(12) United States Patent
Hatton et al.

(10) Patent No.: US 12,331,513 B1
(45) Date of Patent: Jun. 17, 2025

(54) METHOD AND SYSTEM FOR PROVIDING A MOVABLE PRIVACY CURTAIN SUPPORT BEAM

(71) Applicant: CROMPTON VENTURES, LLC, Wilmette, IL (US)

(72) Inventors: Marc Eric Hatton, Wilmette, IL (US); Robert Alfred Blanford, Wilmette, IL (US); Thomas Allan Fitzgerald, Wilmette, IL (US); Glen Ray Platner, Wilmette, IL (US)

(73) Assignee: CROMPTON VENTURES, LLC, Wilmette, IL (US)

( * ) Notice: Subject to any disclaimer, the term of this patent is extended or adjusted under 35 U.S.C. 154(b) by 576 days.

(21) Appl. No.: 17/531,250

(22) Filed: Nov. 19, 2021

Related U.S. Application Data

(60) Provisional application No. 63/115,769, filed on Nov. 19, 2020.

(51) Int. Cl.

| | |
|---|---|
| ***E04B 2/74*** | (2006.01) |
| ***A47H 1/04*** | (2006.01) |
| ***E04B 2/88*** | (2006.01) |
| *A47H 1/00* | (2006.01) |

(52) U.S. Cl.
CPC ..... *E04B 2/74* (2013.01); *A47H 1/04* (2013.01); *E04B 2/88* (2013.01); *A47H 2001/003* (2013.01); *A47H 2001/047* (2013.01); *E04B 2002/7498* (2013.01)

(58) Field of Classification Search
CPC ..... E04B 2/74; E04B 2/88; E04B 2007/7498; A47H 1/04; A47H 2001/003
See application file for complete search history.

(56) References Cited

U.S. PATENT DOCUMENTS

| | | | | | |
|---|---|---|---|---|---|
| 2,706,306 | A | * | 4/1955 | Sheetz | A47H 15/02 248/317 |
| 5,016,318 | A | * | 5/1991 | Harris | E05D 15/0608 160/206 |
| 5,090,171 | A | * | 2/1992 | Kano | E05D 15/0608 160/199 |
| 6,082,053 | A | * | 7/2000 | Bischof | E05F 15/638 52/64 |
| 6,108,989 | A | * | 8/2000 | Kordes | E05C 17/48 52/64 |

(Continued)

*Primary Examiner* — Beth A Stephan
(74) *Attorney, Agent, or Firm* — SMITH TEMPLE; Steven P. Wigmore

(57) ABSTRACT

A movable curtain support system and method may include a movable support beam with two ends and a material hanging on the movable support beam. The system also may include two stationary beams as well as a trolley coupled to each end of the movable support beam and each stationary beam. The trolley may include at least two wheels and a plate. The plate may space apart two sets of wheels. The system may further include a spacer plate that is coupled to the two stationary beams. The spacer plate may be coupled to a vertical rod for suspending the system from a ceiling. The hanging material may include a curtain. The system may further include a third stationary beam positioned adjacent to the two stationary beams and for supporting another curtain. The curtain may be coupled to the movable support beam by a hook.

15 Claims, 12 Drawing Sheets

(56) References Cited

U.S. PATENT DOCUMENTS

| | | | | |
|---|---|---|---|---|
| 6,233,900 | B1 * | 5/2001 | Gill | B25B 5/003 52/584.1 |
| 6,393,772 | B1 * | 5/2002 | McRoberts | G09F 7/18 52/39 |
| 6,405,491 | B1 * | 6/2002 | Gallant | E04H 3/08 52/64 |
| 6,581,345 | B2 * | 6/2003 | Goldsmith | E05D 15/0652 52/243.1 |
| 6,739,096 | B2 * | 5/2004 | Feldpausch | F16M 11/2092 248/327 |
| 8,621,680 | B2 * | 1/2014 | Maes | A47K 3/38 4/610 |
| 8,671,633 | B2 * | 3/2014 | Haab | E05D 15/0604 160/206 |
| 9,222,255 | B2 * | 12/2015 | Johnson | E04B 1/343 |
| 10,914,068 | B2 * | 2/2021 | Shargani | E04F 10/06 |
| 2007/0130853 | A1 * | 6/2007 | Kennedy | E04B 2/74 52/238.1 |
| 2015/0208843 | A1 * | 7/2015 | Ruble | A47H 13/02 24/373 |
| 2017/0009504 | A1 * | 1/2017 | Colacecchi | A47H 1/04 |
| 2021/0127597 | A1 * | 5/2021 | Choe | A01G 9/246 |

* cited by examiner

METHOD AND SYSTEM FOR PROVIDING A MOVABLE PRIVACY CURTAIN SUPPORT BEAM

BACKGROUND

Currently, there are numerous commercial solutions for hanging curtains, drapes, or other materials (referred to as "hanging material") for use as a room divider, to create an enclosed space, or otherwise provide privacy in various applications. The hanging material may comprise any type of textiles, fabrics, cloths, or other flexible materials. Depending on the particular application, the hanging material may be referred to as a cubicle curtain, a hospital curtain, a privacy curtain, a shower curtain, or more generally as a curtain or drape (collectively referred to as "privacy curtains").

For example, hanging movable curtain systems are commonly used in nursing homes, extended care facilities, doctor offices, and other medical treatment facilities to provide patient privacy. The privacy curtains are typically hung using a track system. A track comprising an extruded aluminum or other channel may be attached to a conventional or dropped ceiling, which forms a path around the desired privacy area.

A typical ceiling-mounted track and curtain system employs a series of rollers or gliders that move within the track. A hook may be attached to each roller with, for example, a chain. To drape the privacy curtain around the area defined by the track, each hook is attached to a series of grommets disposed on an upper portion of the privacy curtain. After the hooks have been attached to the grommets, the privacy curtain hangs from the ceiling-mounted track. An individual may pull the privacy curtain to slide it along the track and thereby open and close the privacy area.

Despite their widespread use and commercial success, ceiling-mounted track and curtain systems have many disadvantages. The ceiling-mounted track must generally follow a path that does not block ceiling obstacles (e.g., lights, vents, fire sprinklers, etc.), which may limit the location for optimal use of the rooms and increase custom installation costs. Furthermore, these types of systems may be difficult to install, use, and maintain. Due to the height of the ceiling-mounted track, it may be difficult to repair and clean the track system. Furthermore, a ladder may be required to take down the privacy curtain for maintenance, replacement, and/or cleaning. Because privacy curtains tend to be large in height and length and, therefore, relatively heavy, they can be very cumbersome to hang and take down.

Existing track designs typically use entry and exit points at one or both ends of the track for insertion and removal of the rollers and the curtain. For example, if one roller breaks in the sequence of rollers, all the rollers and the entire curtain up to that point need to be removed from the track in order to replace the broken roller. As known in the art, the rollers may have a relatively short life span due to buildup of materials within the track system. When one or more rollers begin to malfunction, the privacy curtain may no longer smoothly traverse the track, which may cause the privacy curtain to catch or bind and lead to tearing of the hanging material.

Yet another disadvantage of ceiling-mounted track and curtain systems is that they may be required to comply with fire safety standards or regulations. For example, in certain types of health care facilities, there may be material and/or clearance regulations that require the hanging material to be installed some distance below fire sprinklers. To achieve compliance with these and other standards or regulations, many hospital privacy curtains used with ceiling-mounted tracks include a predefined length (e.g., 18 inches) of mesh header as a first upper portion before any solid cloth hanging material. This allows fire sprinklers to work properly in the event of a fire. However, because the mesh is not solid, it tends to get caught in the hooks, which often causes tearing of the mesh. In addition, when the mesh is caught on the hooks, the rollers or gliders may stick in the track, preventing the privacy curtain from working properly.

And yet a further disadvantage in the art is that ceiling-mounted track and privacy curtain systems may be difficult to move out of the way of equipment and/or staff persons which may try to get a patient out of a hospital bed. Often, a lifting device may be employed to help lift a patient out of a hospital bed. And usually, prior art privacy curtain systems may get in the way of lifting equipment and/or personnel needed to help a patient get up and out of a hospital bed.

Accordingly, despite the widespread availability and commercial success of privacy curtains, there remains a need in the art for improved systems, methods, and devices for moving privacy curtains such that they can be placed in a storage position that does not interfere with personnel and/or lifting equipment.

SUMMARY

A movable curtain support system and method may include a movable support beam with two ends and a material hanging on the movable support beam. The system also may include two stationary beams as well as a trolley coupled to each end of the movable support beam and each stationary beam. The trolley may comprise at least two wheels and a plate. The plate may space apart two sets of wheels. The system may further include a spacer plate that is coupled to the two stationary beams. The spacer plate may be coupled to a vertical rod for suspending the system from a ceiling.

The hanging material may comprise a curtain. The system may further include a third stationary beam positioned adjacent to the two stationary beams and for supporting another curtain. The curtain may be coupled to the movable support beam by a hook. And similarly, the curtain may be coupled to the third stationary beam by a hook.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

Figure 1:
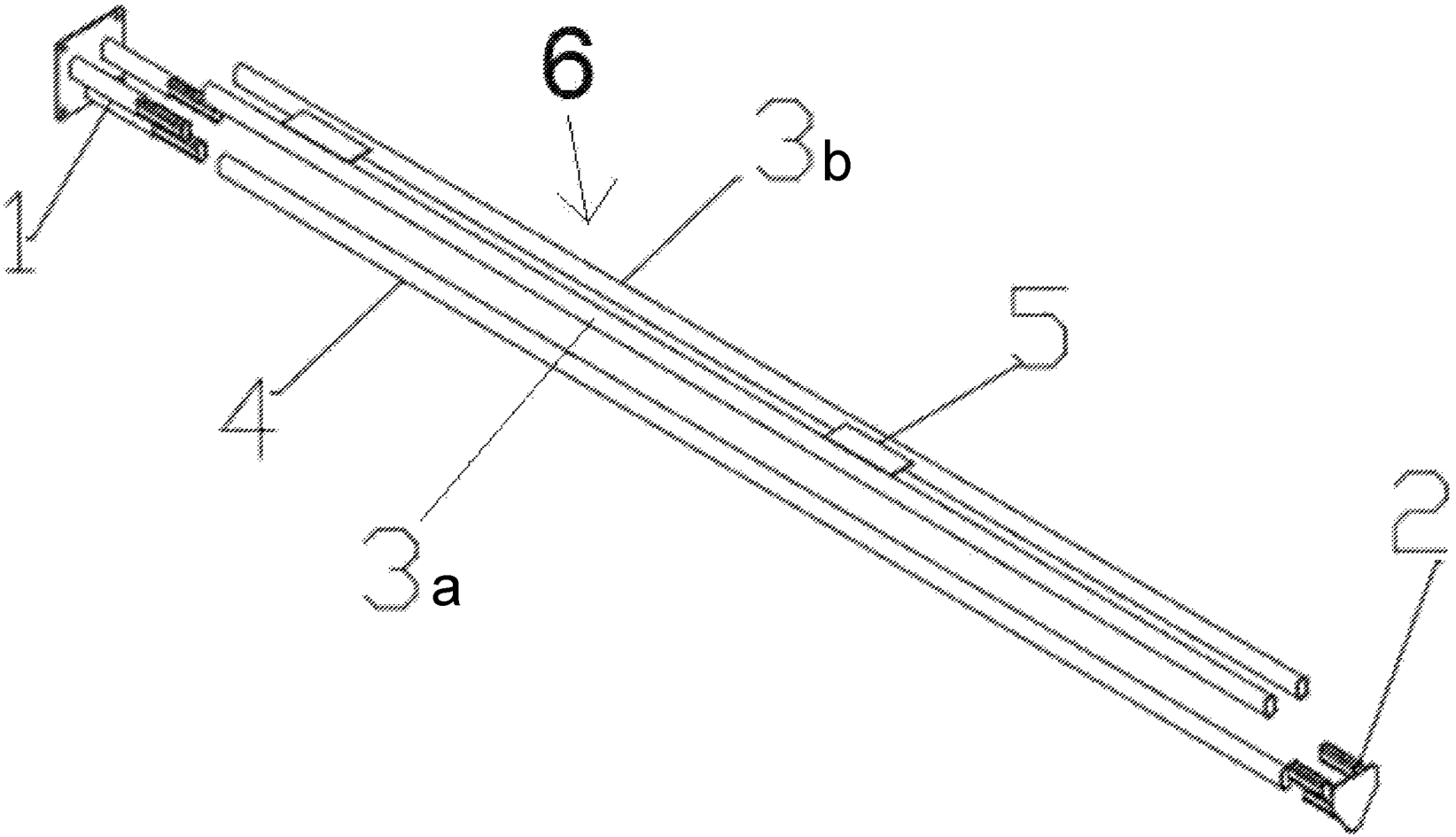
FIG. 1 illustrates a side, perspective view of system and method for providing a movable privacy curtain support beam.
Figure 2:
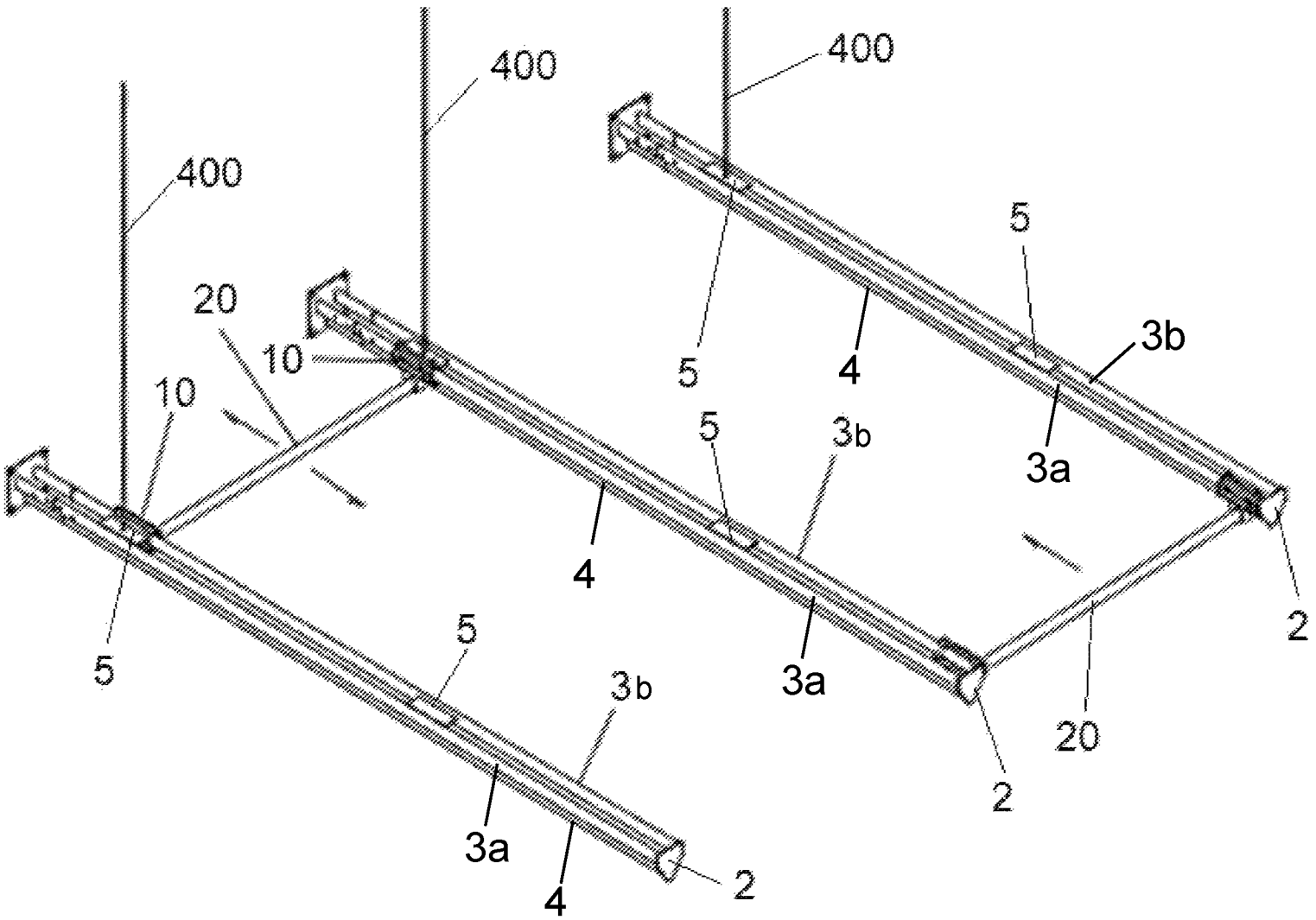
FIG. 2 illustrates the system and method for providing a movable privacy curtain support beam, where the system comprises at least three components, similar to the single component illustrated in FIG. 1.

Referring now to FIG. 1, this figure illustrates a side, perspective view of one component beam 6 of a system 101 and method for providing a movable privacy curtain support beam 20 (see FIG. 2 for beam 20). The component beam 6 of system 101 includes two beams 3*a*, 3*b* where each beam 3*a*, 3*b* supports a trolley 10 (See FIG. 2). The component beam 6 of the system 101 further includes a flat sided oval tube 4 positioned underneath the two beams 3*a*, 3*b*. Spacer plates 5 may be positioned between each of the two beams 3*a*, 3*b*.

The beams 3*a*, 3*b* and oval tube 4 may be coupled to a wall mount assembly 1 and an end mount assembly 2. Each assembly 1, 2 may have rod-like projections which mate with the hollow beams 3*a*, 3*b* and hollow oval tube 4. In this view of FIG. 1, the assemblies 1, 2 are not coupled to the beams 3*a*, 3*b* and tube 4.

Referring now to FIG. 2, this figure illustrates the system 101 and method for providing a movable privacy curtain support beam 20, where the system 101 comprises at least three components 6, similar to the single component beam 6 illustrated in FIG. 1. In this view, the assemblies 1, 2 are coupled to respective beams 3*a*, 3*b* and tubes 4.

A movable support beam or tube 20 is connected between two beam trolleys 10. The beam trolleys 10 and movable support tube 20 slide back and forth between the side support beams 3*a*, 3*b* (see also FIGS. 7-9). The spacer plates 5 coupled to beams 3*a* and/or 3*b* may provide a uniform width between the support beams 3*a*, 3*b* and they may add strength to the support beams 3*a*, 3*b*.

These spacer plates 5 (FIG. 1) can be used to attach vertical support rods 400 (see also FIG. 4) to an overhead structure and they may provide a method to level the beams 3*a*, 3*b*. The configuration of the trolleys 10 (FIG. 2) allow them to move on the support beams 3*a*, 3*b* without contacting the spacer plates 5 that hold the top beams 3*a*, 3*b* together.

Figure 3:
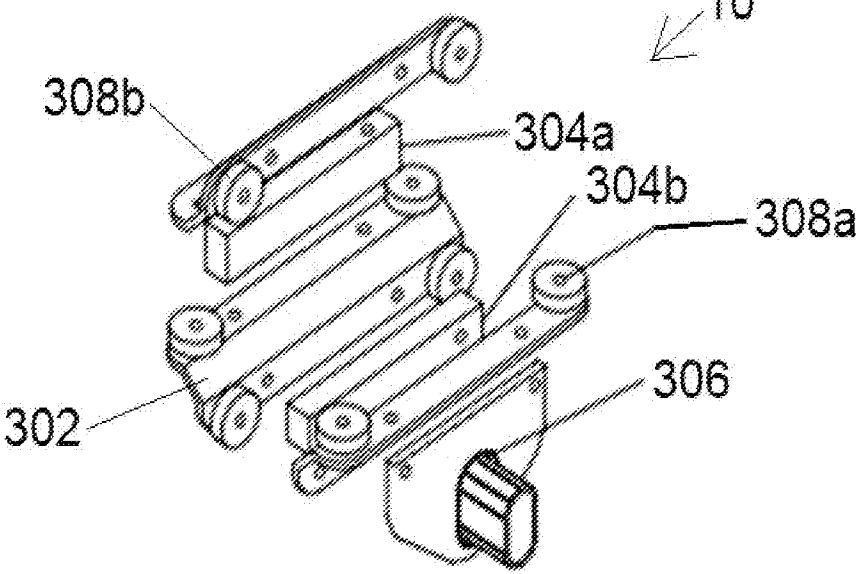
FIG. 3 illustrates a side, perspective view of a trolley.

Referring now to FIG. 3, this figure illustrates a side, perspective view of a trolley 10. The trolley 10 may include three identical plates 302, a vertical height spacer block 304*a*, a bottom width spacer block 304*b*, a tube mount 306 for the movable support beam 20 (see FIG. 2 for beam 20), and multiple wheels 308. The trolley parts are bolted together and hold the wheels 308 in a position around the beam support tube 3. However, other fastening mechanisms, besides bolts, may be used without departing from this disclosure. Other fastening mechanisms include but are not limited to, screws, welds, adhesives, etc.

The trolley 10 provides horizontal, vertical, and parallel alignment on the beam support tubes 3 when the trolleys 10 are attached together with the movable support tube 20. The shape of the moving tube 20 and the trolley tube mount 306 (FIG. 3) may minimize rotation and misalignment of the trolleys 10 in relation to one another during movement. The trolleys 10 can easily be installed and removed from the beam tubes 3 by removing two nuts 702 (see FIG. 6) that secure the lower spacer block 304*b* (FIG. 3). Identical trolleys 10 can be used on either or both top tubes 3 of the beam assembly 6 by rotating the trolley 10 end to end.

Figure 4:
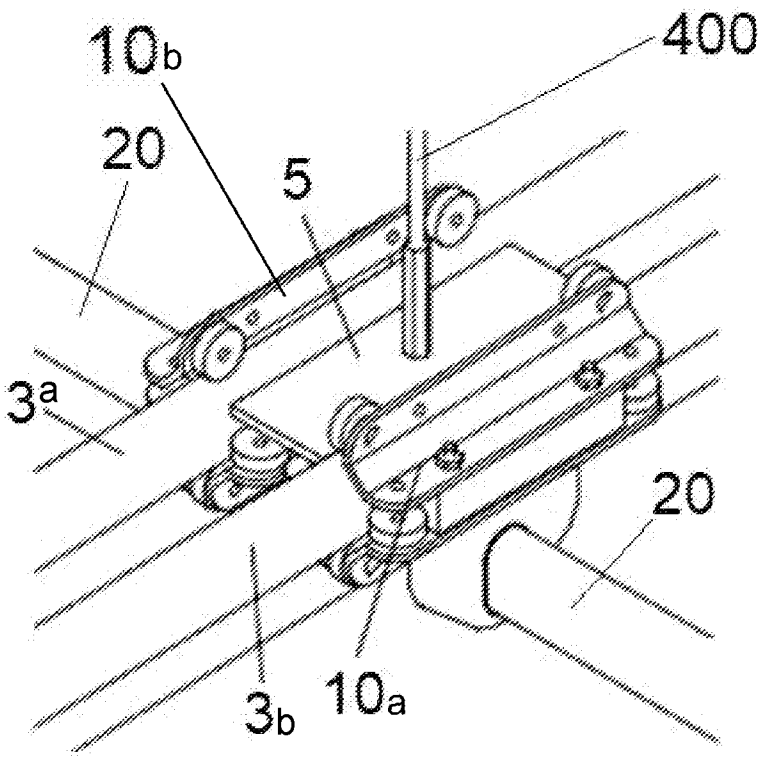
FIG. 4 illustrates a side perspective view of two trolleys coupled to two respective top beams.

Referring now to FIG. 4, this figure illustrates a side perspective view of two trolleys 10*a*, 10*b* coupled to two respective top beams 3*a*, 3*b*. As noted previously, the spacer plates 5 maintain a fixed distance between the top beams 3*a*, 3*b*. This fixed distance is usually a magnitude of about 2.0 inches. However, other distances are possible and are within the scope of this disclosure. The spacer plates 5 also support and are coupled to vertical support rods 400. The vertical support rods 400 may be made of metal and they may be solid. Similarly, the spacer plates may be made from metal and they may be coupled to rods 400 by fastening mechanisms such as, but not limited to, welds. The vertical support rods 400 may be coupled to a ceiling (not shown) by one or more other fastening mechanisms (not shown that include bolts, rods, screws, welds, etc.).

Figure 5:
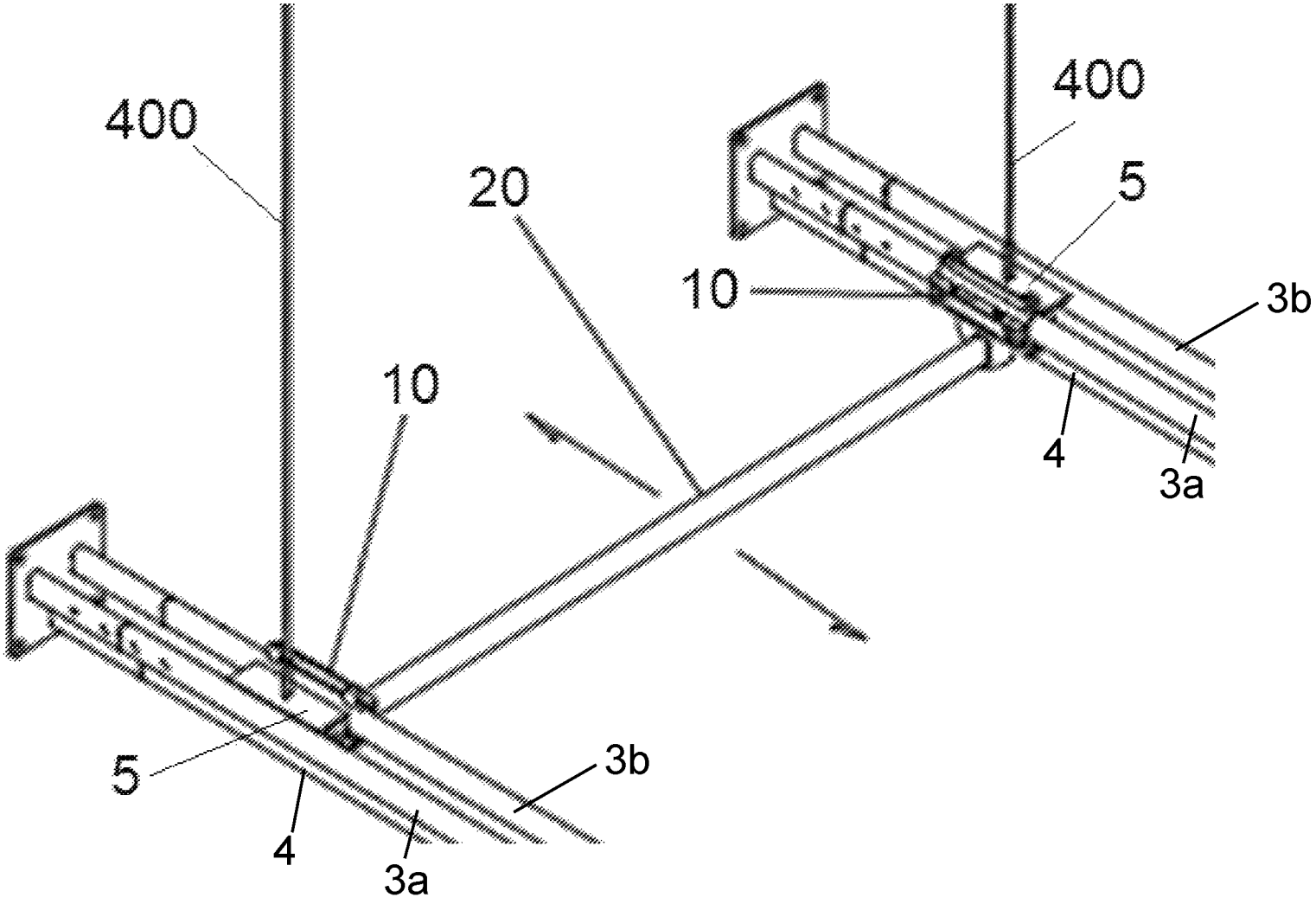
FIG. 5 illustrates a close up view of the movable support beam and its coupling and its support by two trolleys.

Referring now to FIG. 5, this figure is a close up, side perspective view of the movable support tube 20 and its coupling and support by two trolleys 10. A hanging material (i.e. such as, but not limited to, a curtain) 706*a* (FIGS. 7-9) may be hung from the bottom flat sided oval tube 4 adjacent to the support beams 3 while a center curtain 706*b* is hung from the movable support tube 20. The support beams 3 are held in position by a wall mount assembly 1 (FIG. 1), and an outer end assembly 2 (FIG. 1). Each top tube assembly 6 (FIG. 1) may comprise two tubes 3*a*, 3*b* and two spacer plates 5, and a bottom tube 4.

This system 101 can be utilized for areas such as welding, fabrication and medical facilities. Multiple hanging systems 101 can be placed side by side by using two trolleys 10 on the center beams 3 and one trolley 10 on the top inside tube of the outer beams 3 (see also FIGS. 7-9).

Figure 6:
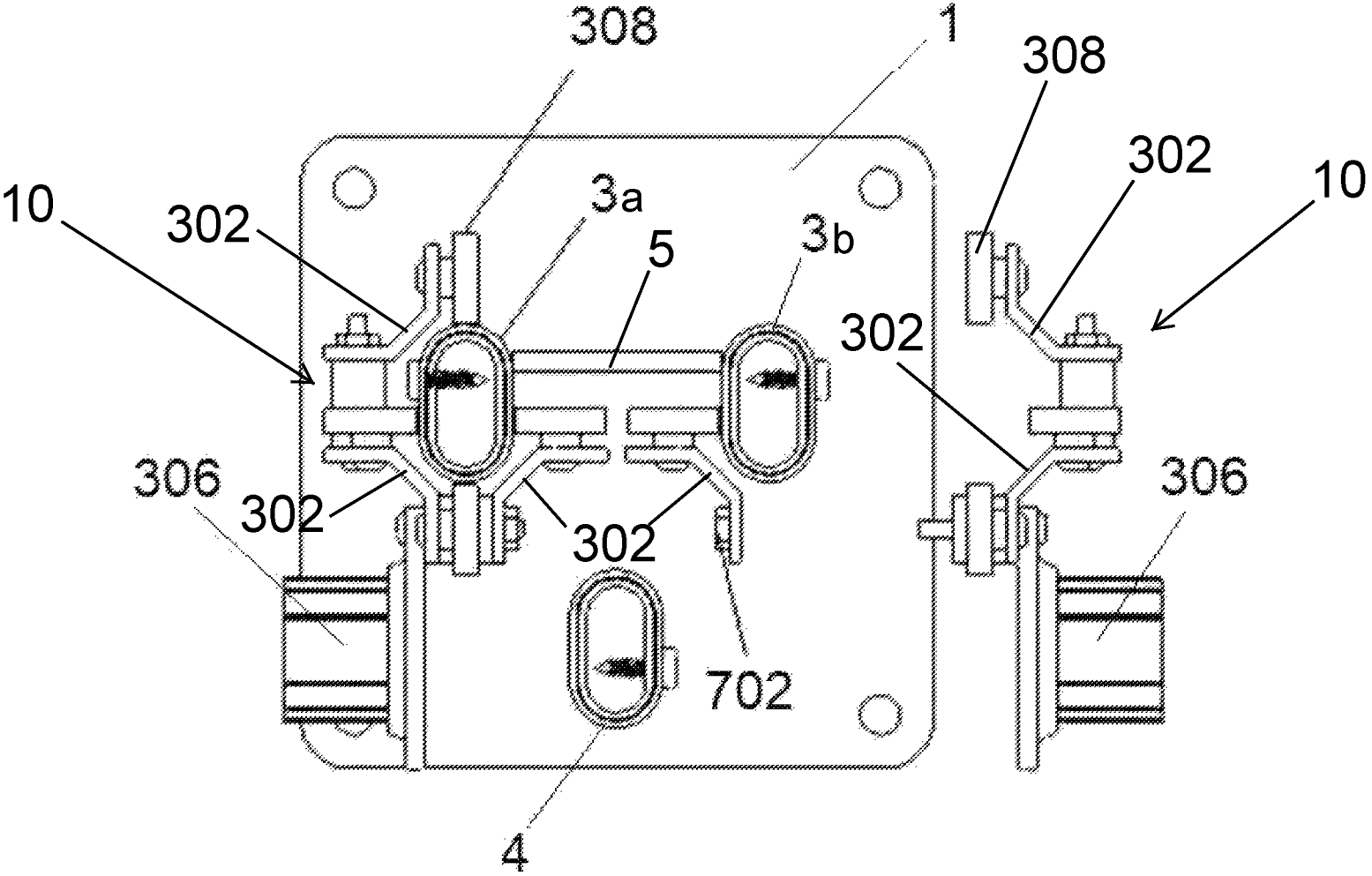
FIG. 6 illustrates a cross-sectional view of the outer beams as well as the bottom tube and spacer plate.

Referring now to FIG. 6, this figure illustrates a cross-sectional view of the outer beams 3*a*, 3*b* as well as the bottom oval tube 4 and spacer plate 5. The beams 3*a*, 3*b* support the wheels 308 of the trolleys 10. The trolleys 10 have plates 302. The plates 302 provide support for the wheels 308 of the trolleys 10. The beams 3*a*, 3*b* with trolleys 10 provide a smooth non-binding moving system 101.

Figure 7A:
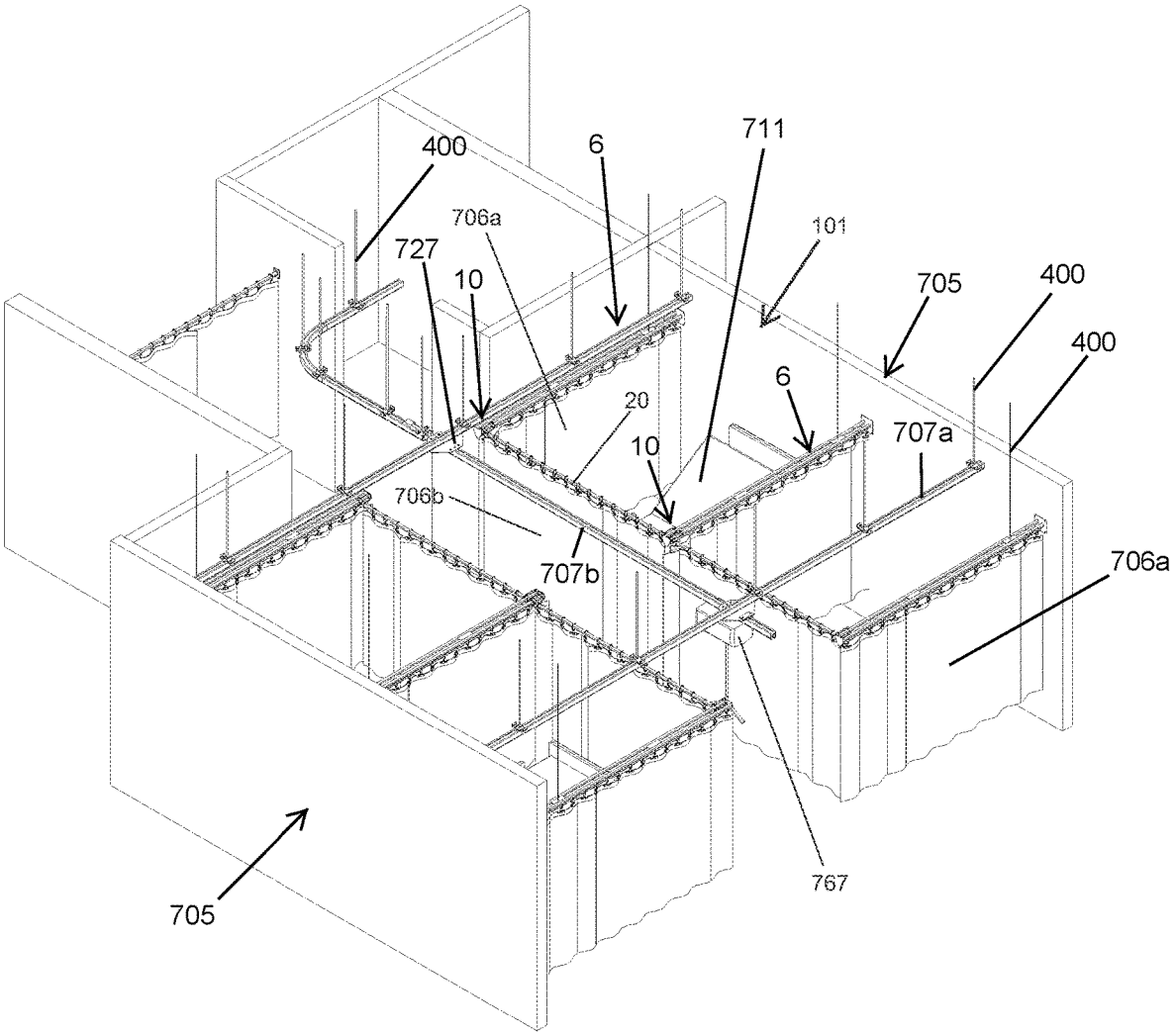
FIG. 7*a* illustrates the system for providing a movable privacy curtain support beam that is in a hospital or health care setting/environment.

Referring now to FIG. 7*a*, this figure illustrates the system 101 for providing a movable privacy curtain support beam 20 that is in a hospital or health care setting/environment. The exemplary environment of FIG. 7*a* includes walls 705.

Each component beam 6 that has two beams 3*a*, 3*b* and tube 4 (See FIG. 1) is coupled to a wall 705. Each component beam 6 is further suspended from a ceiling and/or ceiling components (not shown) by vertical support rods 400. The vertical support rods 400 are coupled to the spacer plates 5 of each component beam 6 as described previously (see FIG. 4).

Hanging from each tube 4 (see FIG. 6) and movable support beam 20 are curtains 706. In FIG. 7*a*, a machine 767 in a first position is at a first distance from the system 101. This machine 767 may comprise a lifting device or handle that a hospital patient may grasp to pull his or herself out of the bed 711. Other machines 767 are possible and are within the scope of this disclosure as understood by one of ordinary skill in the art. This machine 767 is supported by a track or beams 707*a*, 707*b*. One of the tracks 707*b* may be coupled to one of the component beams 6 at a junction 727. The tracks 707*a,b* are also supported from the ceiling (not shown) by vertical support rods 400 similar to how component beams 6 are supported by their vertical support rods 400. In FIG. 7*a*, the movable support beam 20 supported by the trolleys 10 is also in a first position.

Figure 7B:
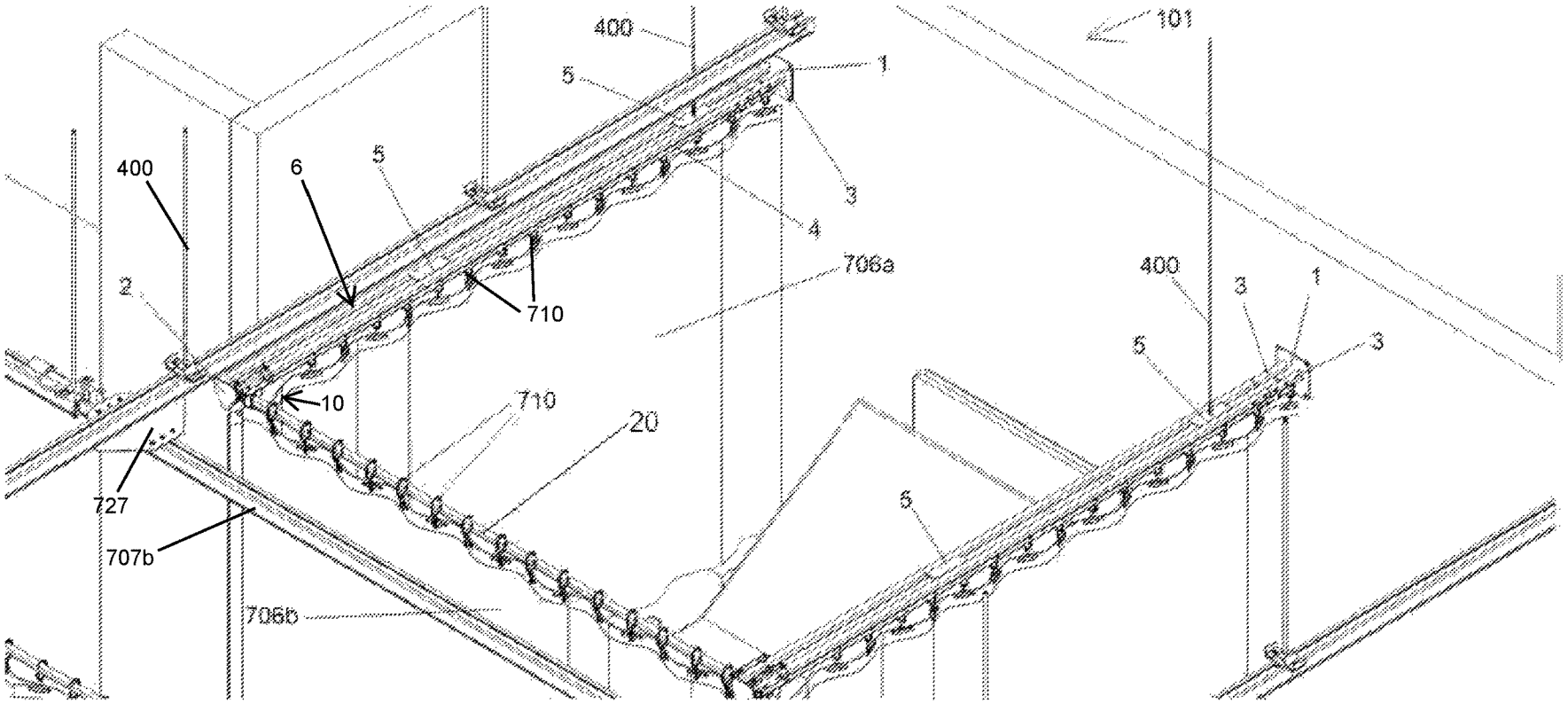
FIG. 7*b* illustrates an enlarged view of the system for providing a movable privacy curtain support beam shown in FIG. 7*a;*

Referring now to FIG. 7*b*, this figure illustrates an enlarged view of the system 101 for providing a movable privacy curtain support beam 20 shown in FIG. 7*a*. In FIG. 7*b*, similar to FIG. 7*a*, the track 707 for the machine 767 (not visible in FIG. 7*b*) is also supported from the ceiling by vertical support rods 400 similar to how component beams 6 are supported by their vertical support rods 400.

In FIG. 7*b*, the movable support tube 20 supported by the trolleys 10 is also in a first position. FIGS. 7*b*-9*b* show each curtain 706 supported by hooks 710. These hooks 710 and corresponding support structure are described in commonly assigned U.S. Pat. No. 10,264,908, which is incorporated by reference in its entirety. Specifically, hooks 710 support the curtain 706*b* hanging from the movable support tube 20. Similarly, hooks 710 support curtain 706*a* hanging from bottom/lower tube 4 which is part of the component beam 6 described previously (see FIG. 1). The track 707*b* for supporting the machine 767 (see FIG. 7*a*) is also in a first position shown in FIGS. 7*a*-7*b*.

Figure 8A:
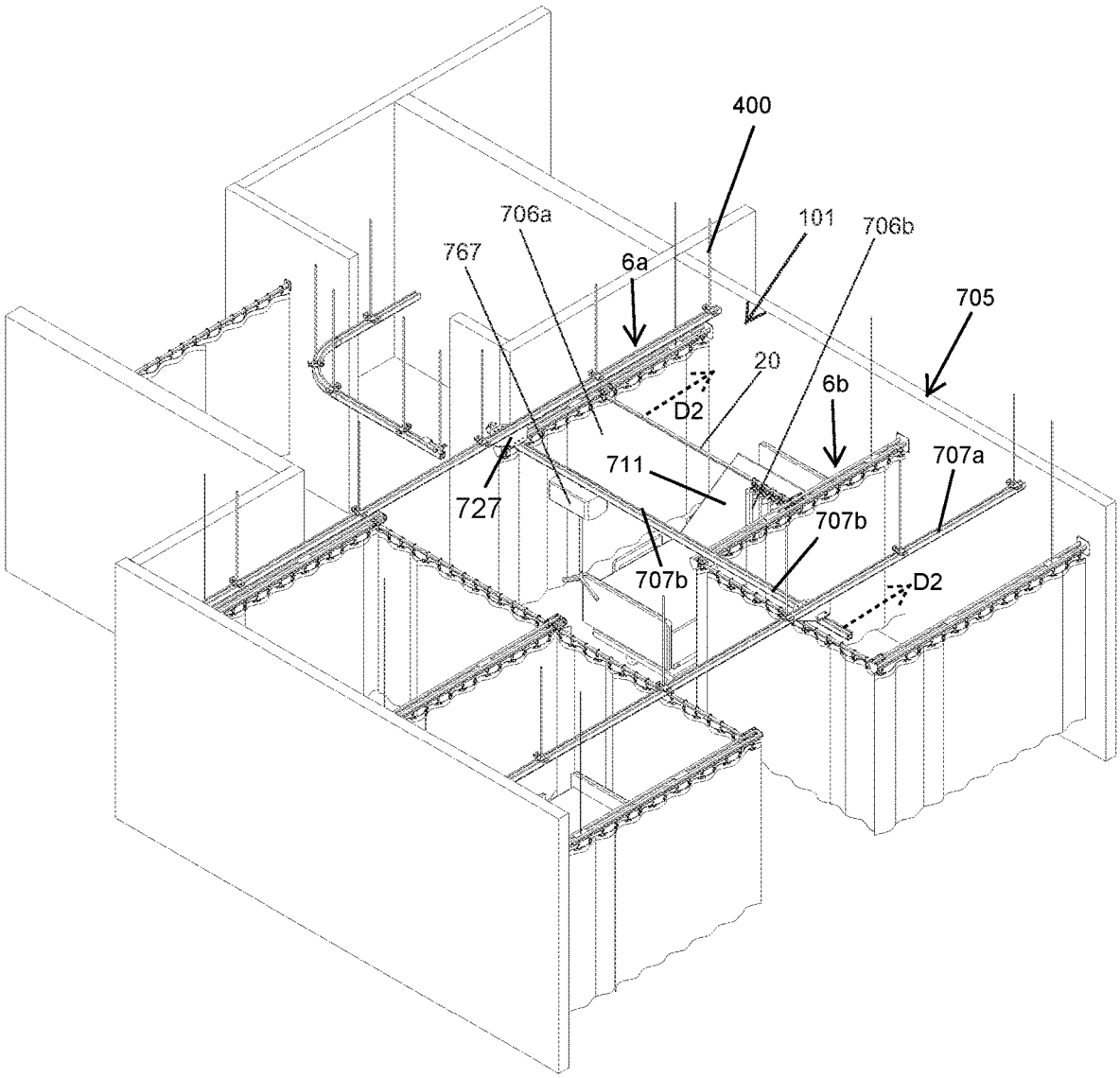
FIG. 8*a* illustrates the machine in a second position that is at a second distance from the system compared to FIG. 7*a;*

Referring now to FIG. 8*a*, this figure illustrates the machine 767 in a second position that is at a second distance from the system 101 compared to FIG. 7*a*. This second distance of FIG. 8*a* is much shorter than the first distance shown in FIG. 7*a*. The movable support beam 20 which has a curtain 706*b* is now in a second position moving towards a wall 705 as shown by dashed directional arrow D2. Also, the second track 707*b* which directly supports the machine 767 has also moved/shifted towards the right of the page of FIG. 8*a* relative to component beams 6*a*, 6*b* and along first track 707*a* as shown by another dashed directional arrow D2. The curtain 706*b* was also moved along the support beam 20, such that it occupies mostly the right side of the beam 20 as illustrated in FIG. 8*a*.

Figure 8B:
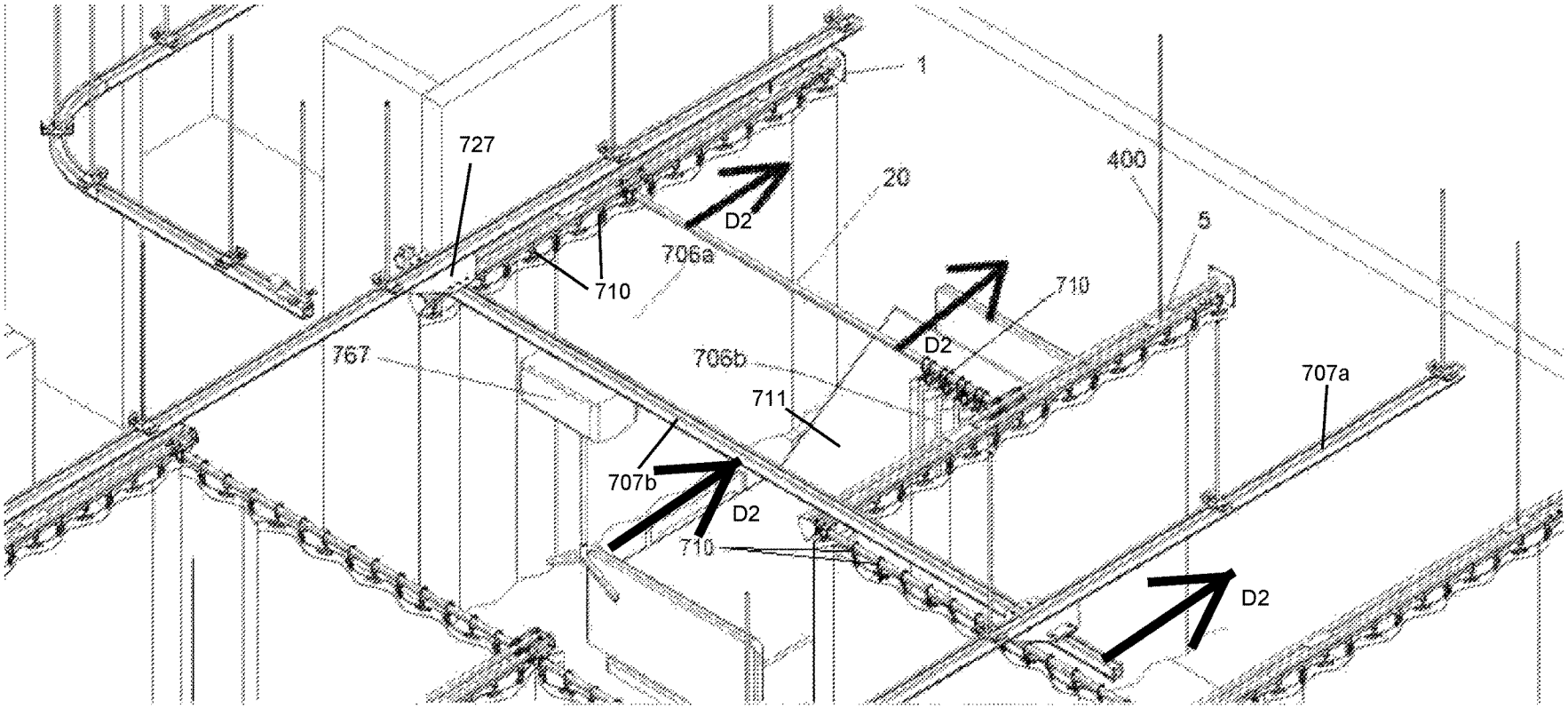
FIG. 8*b* illustrates is an enlarged view of a portion of FIG. 8*a* so that additional details like the hooks for curtains are now visible.

Referring now to FIG. 8*b*, this figure illustrates is an enlarged view of a portion of FIG. 8*a* so that additional details like the hooks 710 for curtains 706 are now visible. Directional arrows D2 of FIG. 8*b* show how the movable support beam 20 as well as the second track 707*b* supporting machine 767 have changed their position relative to FIGS. 7*a*-7*b*. Smooth movement of the support beam 20 is made possible with trolleys 10 described above which "ride" along the support beams 3*a*, 3*b*.

Figure 9A:
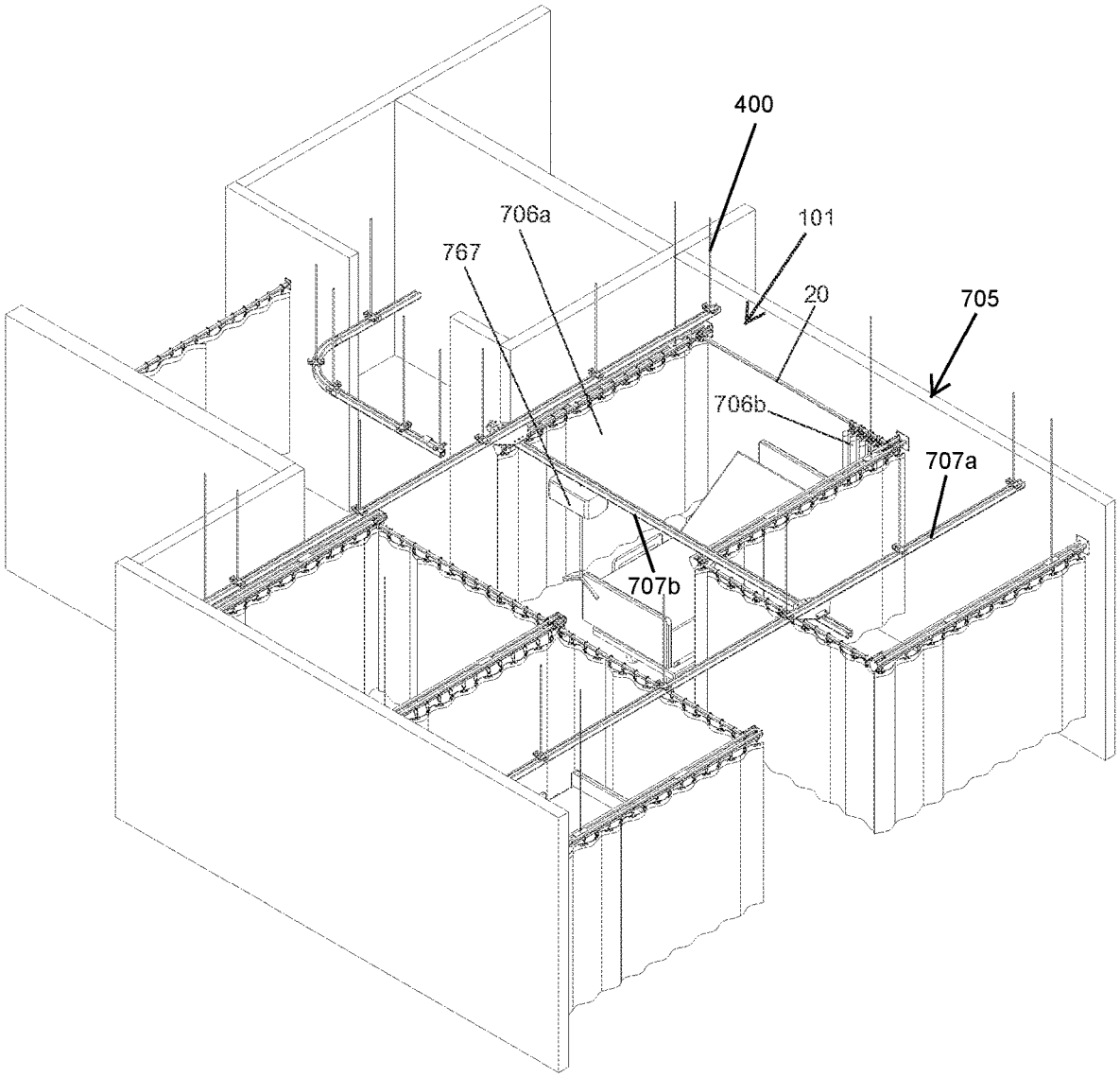
FIG. 9*a* illustrates the machine and its support track still in the second position but the movable support tube which has curtain has been shifted to a third position, very close to a wall relative to the first position illustrated in FIGS. 7*a*-7*b;*

Referring now to FIG. 9*a*, this figure illustrates the machine 767 and its support track 707*b* still in the second position but the movable support tube 20 which has curtain 706*b* has been shifted to a third position, very close to a wall 705 relative to the first position illustrated in FIGS. 7*a*-7*b*. Because of the mobility of the movable support tube 20, the machine 767 may be moved closer to the wall 705 and bed 711 without interference or collision/contact with the curtain 706*b*, which has been slid to the right side of the support tube 20 while support tube is positione very close to the wall 705.

Figure 9B:
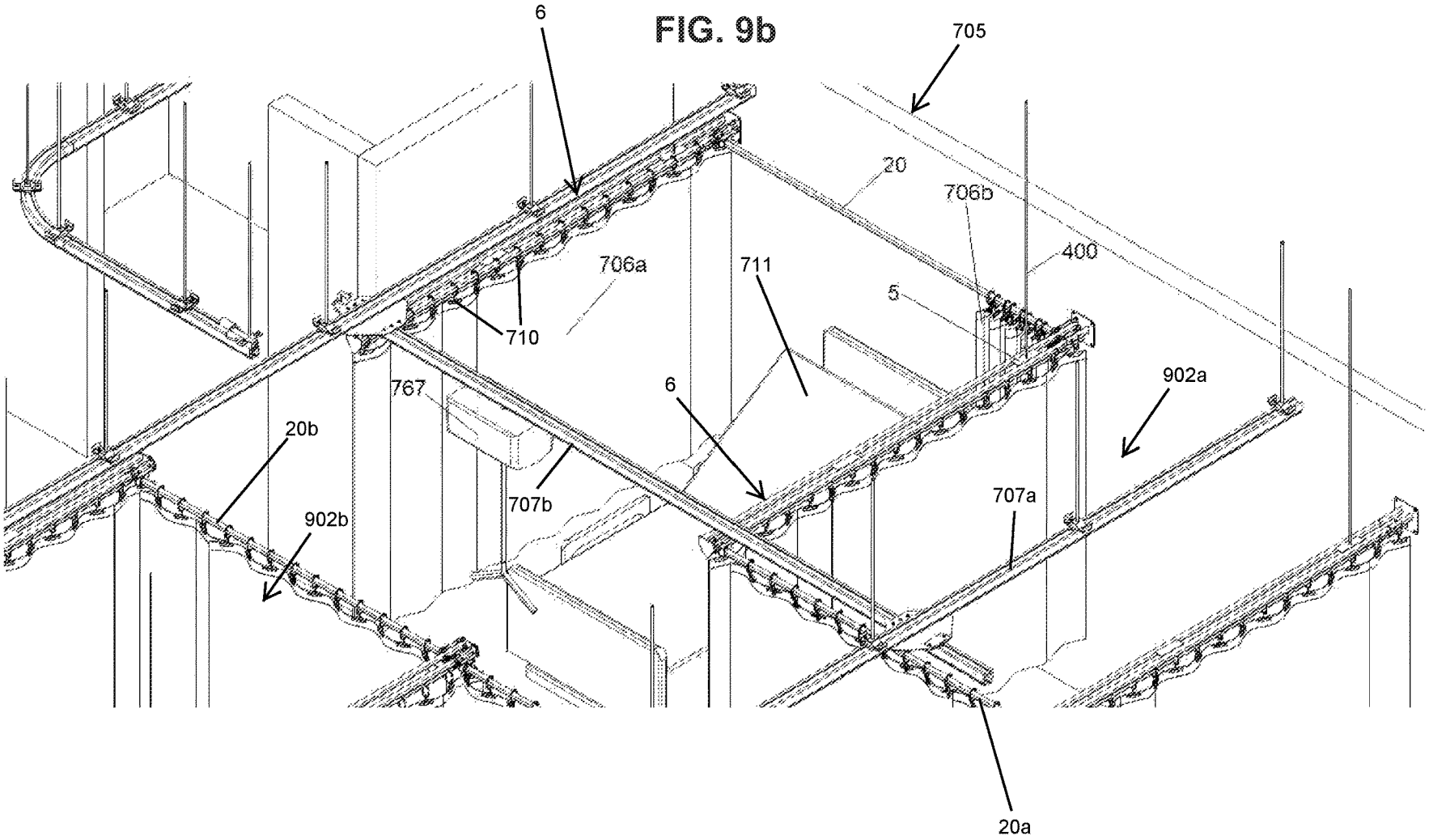
FIG. 9*b* is an enlarged view of FIG. 9*a* illustrating how the movable support tube which has curtain has been shifted to a third position.

Referring now to FIG. 9*b*, this is an enlarged view of FIG. 9*a* illustrating how the movable support tube 20 which has curtain 706*b* has been shifted to a third position. In this view of FIG. 9*b*, further details such as the hooks 710 that support the curtains 706*a*, 706*b* on the lower oval tube 4 of the component beam 6 and the movable support tube 20 are now visible. FIG. 9*b* further illustrates how additional bays 902*a*, 902*b* that may house or enclose beds 711 (not shown) may also have their own movable support tubes 20*a*, 20*b*. The other support tubes 20*a*, 20*b* holding their own curtains 706 may be moved towards respective walls 705 like the first support tube 20 described above.

Figure 10:
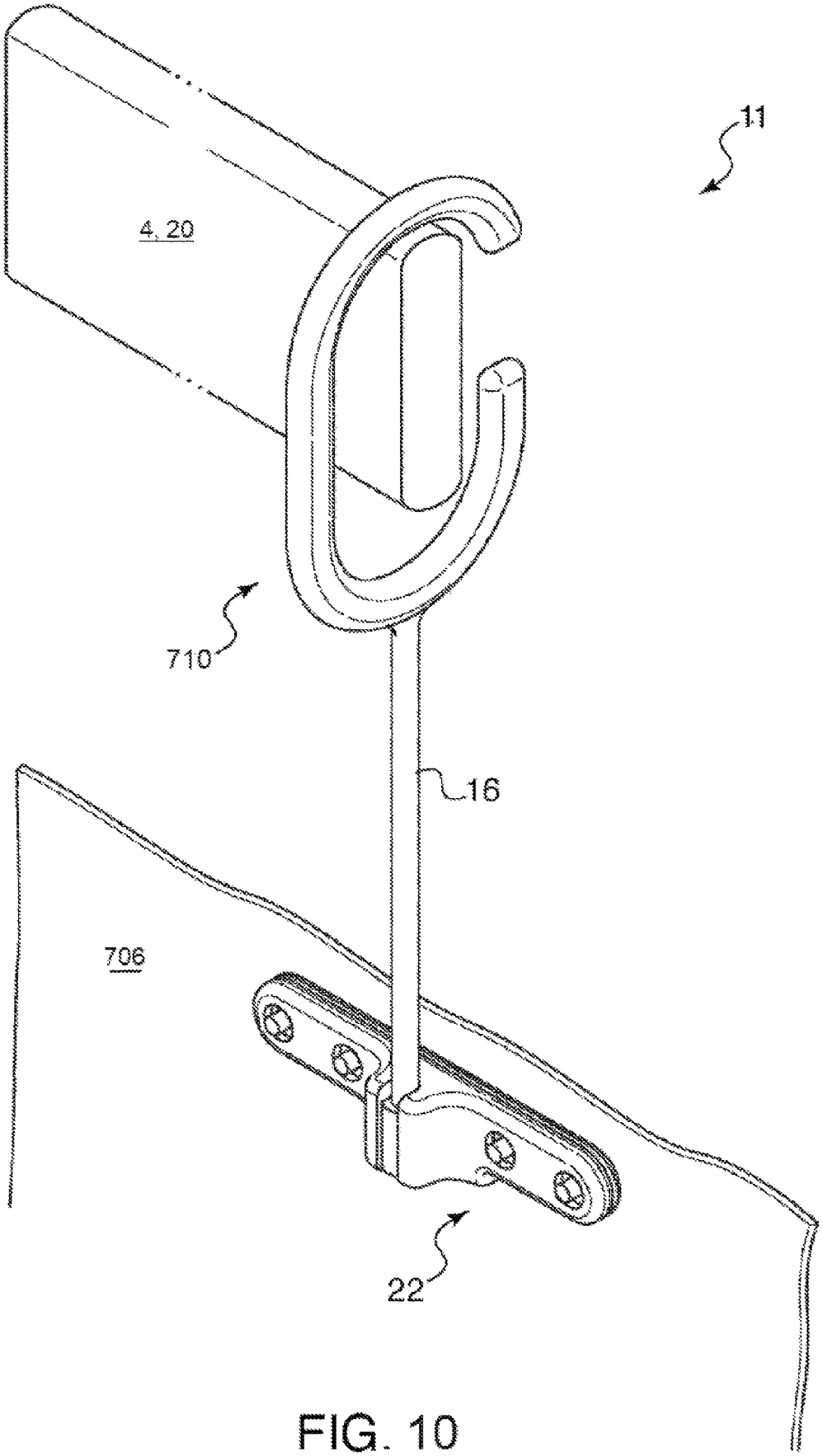
FIG. 10 illustrates an exemplary embodiment of a curtain support and swivel assembly which has an attachment member or hook.

Referring now to FIG. 10, this figure illustrates an exemplary embodiment of a curtain support and swivel assembly 11 which has an attachment member or hook 710 as described and shown in the prior figures. The curtain support and swivel assembly 11 comprises a support rod 16 and an attachment member 22, which cooperate together in use to provide a swivel or rotation feature. The hook 710, also referred to as a support attachment member, extends from one end of the support rod 16. The hook 710 may be integrally formed with the support rod 16.

In other exemplary embodiments, the hook 710 may be removably attached to the support rod 16 to support various attachments for integration with different types of horizontal support structures. As illustrated in the embodiment of FIG. 10, the hook 710 may comprise a C-shaped/C-type hook for quick, easy, and safe attachment to a horizontal tube/beam 4, 20. As known in the art, each tube/beam 4, 20 may comprise a series of straight and/or curved sections to define the area to be enclosed by the privacy curtain 706.

The C-type hook 710 allows the structure to be easily hung from the installed horizontal tubes 4, 20, such as the lower oval tube 4 of the component beam 6 or from the movable tube 20 described previously. It should be further appreciated that the C-type hook 710 may be formed from various desirable materials to provide appropriate friction contact between it and any horizontal tube 4, 20. In an embodiment, the C-type hook 710 may be formed from a flexible material (e.g., polypropolene) for enabling its curved portions to bend. The bending or flexing of the curved portions may increase the opening of the hook 710, thereby enabling the C-type hook 710 to be easily installed around any horizontal tube 4, 20.

The word "exemplary" is used herein to mean "serving as an example, instance, or illustration." Any aspect described herein as "exemplary" is not necessarily to be construed as exclusive, preferred or advantageous over other aspects.

All components disclosed may be designed for sheet metal stamping processes. Metal stamping (also known in the art as pressing) is a process that utilize stamping presses and metal forming tools (dies) to transform flat metal sheets into shapes by forming a sheet metal placed between two halves of a press tool. Other manufacturing methods are also possible, and are included within the scope of this disclosure. Other methods include, but are not limited to, rolling, casting, molding, or milling, etc. as understood by one of ordinary skill in the art.

As specific examples, the materials for the parts illustrated in the several figures may be made of metal, such as aluminum or steel. Other metals may be employed without departing from the scope of this disclosure. Other metals include, but are not limited to, bronze, copper, tin, lead, and alloys/combinations thereof.

Further, other materials besides metals are also possible and are included within the scope of this disclosure. Other materials besides metals include, but are not limited to, polymers (i.e. plastics), ceramics, composite materials, and any combination thereof.

The exemplary embodiments of the inventive method and system 101 described above are interchangeable as understood by one of ordinary skill in the art. Various embodiments may be combined with other embodiments without departing from the scope of this disclosure. That is, one or more embodiments illustrated in the several figures may be combined together.

Further, certain steps in the processes or process flows enabled by the mechanical drawings in this specification and the appendix naturally precede others for the invention to function as described. However, the invention is not limited to the order of the steps described if such order or sequence does not alter the functionality of the invention. That is, it is recognized that some steps may be performed before, after, or parallel (substantially simultaneously with) other steps without departing from the scope and spirit of the invention. In some instances, certain steps may be omitted or not performed without departing from the invention.

Although a few embodiments have been described in detail above and illustrated in the several figures, those skilled in the art will readily appreciate that many modifications from those which were described and as illustrated are possible in the embodiments without materially departing from this disclosure.

Accordingly, such modifications are intended to be included within the scope of this disclosure as defined in the following claims. For example, while several walls are illustrated for the junction box, it is possible that these walls be replaced/substituted by additional and/or fewer structures.

Further, mechanical equivalents of any of the illustrated structures could be substituted for many of the structures illustrated in the several views as understood by one of ordinary skill in the art. Such substitutions of mechanical equivalent structures are included within the scope of this disclosure.

Similarly, in the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

It is the express intention of the applicant not to invoke 35 U.S.C. § 112, sixth paragraph for any limitations of any of the claims herein, except for those in which the claim expressly uses the words 'means for' together with an associated function.

Therefore, although selected aspects have been illustrated and described in detail, it will be understood that various substitutions and alterations may be made therein without departing from the spirit and scope of the present disclosure, as defined by the following claims.

What is claimed is:

1. A movable curtain support system, comprising:

a movable support beam with a first end and a second end;

a curtain material hanging from the movable support beam;

first and second stationary beams, the first stationary beam positioned at about a ninety degree angle relative to the movable support beam, the second stationary beam positioned at about a ninety degree angle relative to the movable support beam; and a first trolley coupled to the first end of the movable support beam, a second trolley coupled to the second end of the movable support beam, each of the trolleys comprises at least two wheels, the at least two wheels comprising a first wheel and a second wheel, the first wheel being positioned at about a ninety degree angle relative to the second wheel, the first and second wheel of the first trolley ride along and contact the first stationary beam during movement of the movable beam, the first and second wheel of the second trolley ride along and contact the second stationary beam during movement of the movable beam.

2. The system of claim 1, wherein each of the trolleys comprises the at least two wheels and a plate.

3. The system of claim 2, wherein the plate spaces apart two sets of wheels of the at least two wheels.

4. The system of claim 1, further comprising a spacer plate coupled to each of the stationary beams.

5. The system of claim 4, wherein each of the spacer plates is coupled to a vertical rod.

6. The system of claim 1, further comprising a third stationary beam positioned adjacent to the first and second stationary beams, the curtain material being a first curtain material, the third stationary beam supporting a second curtain material.

7. The system of claim 1, wherein the curtain material is coupled to the movable support beam by a hook.

8. The system of claim 6, wherein the second curtain material is coupled to the third stationary beam by a hook.

9. A movable curtain support system, comprising:

a movable support beam with a first and a second end;

a curtain material hanging from the movable support beam;

a first, a second, and a third stationary beam; the first stationary beam positioned at about a ninety degree angle relative to the movable support beam, the second stationary beam positioned at about a ninety degree angle relative to the movable support beam; and a first trolley coupled to the first end of the movable support beam, a second trolley coupled to the second end of the movable support beam, each of the trolleys comprises at least two wheels, the at least two wheels comprising a first wheel and a second wheel, the first wheel being positioned at about a ninety degree angle relative to the second wheel, the first and second wheel of the first trolley ride along and contact the first stationary beam during movement of the movable beam, the first and second wheel of the second trolley ride along and contact the second stationary beam during movement of the movable beam.

10. The system of claim 9, wherein the third stationary beam is not coupled to any of the trolleys and supports a curtain material.

11. The system of claim 9, wherein each of the trolleys comprises at least two wheels and a plate.

12. The system of claim 11, wherein the plate spaces apart two sets of wheels of the at least two wheels.

13. The system of claim 9, further comprising a spacer plate coupled to each of the stationary beams which support the first and second trolleys.

14. The system of claim 13, wherein each of the spacer plates is coupled to a vertical rod.

15. The system of claim 9, wherein the curtain material is coupled to the movable support beam by a hook.

* * * * *